United States Patent [19]

Green et al.

[11] Patent Number: 4,643,666

[45] Date of Patent: Feb. 17, 1987

[54] METHOD OF BURNING HYDROGEN DEFICIENT FUELS

[75] Inventors: Gary J. Green, Yardley, Pa.; Harry A. McVeigh, Moorestown; Joe E. Penick, Princeton, both of N.J.; Tsoung Y. Yan, Philadelphia, Pa.

[73] Assignee: Mobil Oil Corporation, New York, N.Y.

[21] Appl. No.: 659,123

[22] Filed: Oct. 9, 1984

[51] Int. Cl.[4] ..... F23C 1/00

[52] U.S. Cl. ..... 431/4; 431/2; 44/52; 48/197 FM

[58] Field of Search ..... 431/2, 3, 4; 44/50, 44/52; 48/197 FM; 208/48 R

[56] References Cited

U.S. PATENT DOCUMENTS

| | | | |
|---|---|---|---|
| 2,866,693 | 12/1958 | Allen | 44/52 |
| 3,672,853 | 6/1972 | Roman et al. | 44/52 |
| 4,017,268 | 4/1977 | Gilley | 44/52 |
| 4,045,189 | 8/1977 | Bruni et al. | 44/52 X |
| 4,197,081 | 4/1980 | Osborg | 431/2 |
| 4,490,152 | 12/1984 | Bruni et al. | 44/50 |

FOREIGN PATENT DOCUMENTS

| | | | |
|---|---|---|---|
| 134365 | 2/1979 | Fed. Rep. of Germany | 431/4 |
| 78491 | 5/1982 | Japan . | |
| 840351 | 7/1960 | United Kingdom | 431/4 |

*Primary Examiner*—Margaret A. Focarino
*Attorney, Agent, or Firm*—A. J. McKillop; M. G. Gilman; M. V. Schneller

[57] ABSTRACT

The burning characteristics of a relatively hydrogen deficient fuel are improved by physically mixing with, but not dissolving in, the fuel a light hydrogen rich vapor, such as hydrogen and/or methane, ethane, etc.

19 Claims, 3 Drawing Figures

METHOD OF BURNING HYDROGEN DEFICIENT FUELS

BACKGROUND OF THE INVENTION

1. Field of the Invention

The invention relates to a process for improving the burning characteristics of a hydrogen deficient fuel by adding a hydrogen rich fuel prior to combustion.

2. Relevant Art

It is very difficult to burn low quality fuels, e.g., resids, efficiently with minimum impact on the environment, i.e., complete combustion with low soot formation and a particulate emission.

Low quality, heavy fuels such as resids are used to fuel power plants, ship boilers, and some refinery process units. These fuels are deficient in hydrogen and prone to form soot, leading to black smoke and particulate emissions. It is known that such fuels can be upgraded by hydrogenation. Hydrogenation of heavy resids is a very expensive refinery process, because of the high pressure required and high hydrogen consumption. As an alternative to the chemical addition of hydrogen to residual fuels to improve their combustion quality, the art has sought alternative ways of improving these fuels.

A significant improvement in the efficiency of burning heavy fuels can be achieved if a pressure-type atomizer is used. These atomizers result in the formation of minute droplets of liquid which leave the atomizer to enter a combustion chamber. Usually the feed is heated before reaching the atomizer, so that the viscosity of the feed is low enough for the feed to be atomized. Typically, atomizers work with feeds with a viscosity, measured at the temperature encountered in the atomizer, below 100 CS, and preferably below about 20 CS.

The art has recognized that pressure atomization is not a complete solution, and has attempted to overcome the shortcomings of this method by adding various substances to the feed which promote vaporization and/or reduce the viscosity of the feed. Typical of this work is that described in U.S. Pat. No. 3,672,853, the entire contents of which is incorporated herein by reference. The patentees taught dissolving carbon dioxide, hydrogen or water vapor in the feed in an amount not exceeding 95 percent of the maximum amount that can dissolve at the temperature and pressure just before atomization. The dissolved materials all reduced the viscosity of the feed. At 280° C., 95 kg/cm$^2$ $CO_2$ pressure, the viscosity of a heavy feed was reduced from 1670 CP to 820 CP, with the dissolution of $CO_2$.

In a similar test, with hydrogen addition, more than twice this pressure was used. A feed with an initial viscosity at 280° C. of 1580 cp was reduced to 1350 cp.

Another example in this reference showed equilibrating the same feed used in Example 1 with steam at a steam pressure of 60 kg/cm$^2$ which resulted in reducing the viscosity by approximately a factor of 2 (based on linear extrapolation).

At the 280° C. temperature, hydrogen was by far the least effective additive regards viscosity reduction, and also the least effective regards the severity of conditions needed to dissolve the hydrogen in the heavy liquid feed. The effectiveness of the hydrogen as a viscosity reducer tended to increase, relative to $CO_2$ and $H_2O$, at higher temperatures.

The patentee did not report any results of actual burning experiments using any of these additives, namely $CO_2$, $H_2$, or $H_2O$. Apparently the inventors sought better atomization of fuel, rather than reduced sooting tendency. One advantage mentioned for the process was permitting burning heavy fuels to form soot, and recycle the soot back to the feed. Soot recycle increases feed viscosity, but the viscosity would then be lowered by the practice of their invention.

Unfortunately, none of the solutions to minimizing the sooting tendency of heavy, hydrogen deficient fuels suggested by U.S. Pat. No. 3,672,853 was completely satisfactory.

Use of atomizing steam improves combustion of heavy fuels, but sooting was still a problem.

$CO_2$ is a moderately expensive, and corrosive, commodity. Addition of $CO_2$ reduces the viscosity of a heavy feed, but does nothing towards reducing the sooting tendency of a heavy feed, although better atomization may reduce soot formation.

Dissolution of hydrogen in a heavy feed reduces the sooting tendency of the feed, but would be expensive, in terms of compression costs to achieve sufficiently high hydrogen partial pressures to significantly reduce the viscosity (and inherently) the sooting tendencies of a heavy fuel. Many existing fuel distribution systems could not tolerate the high pressures required.

Some work was done in Japanese Pat. No. 78491 towards reducing the smoking tendency of diesel fuels. Basically an LPG, or liquified petroleum gas stream consisting primarily of propane and butane is dissolved in a tank of diesel fuel to reduce the sooting tendency.

Diesel fuel is a good quality fuel if you just want to burn it in a boiler or process heater. No elaborate steam atomization, etc. is required to cleanly burn this premium liquid fuel. Improving the burning characteristics of diesel fuel by adding valuable materials such as propane and butanes represents very poor use of these materials, but such a fuel would have little sooting tendency.

Other hydrogen deficient fuels range from very light materials, such as acetylene, to heavier liquids such as highly aromatic fuels such as toluene or liquids derived from coal.

We discovered a way to improve the burning tendencies of hydrogen deficient fuels by adding a hydrogen-rich gas, without dissolving the gas in the fuel. We physically mixed a hydrogen rich fuel with the hydrogen-deficient fuel, at the burner.

SUMMARY OF THE INVENTION

Accordingly the present invention provides a process for improving the burning characteristics of a fuel which is relatively deficient in hydrogen and has a tendency to form soot upon combustion, comprising physically admixing with said heavy fuel oil a relatively hydrogen-rich fuel prior to combustion, wherein a majority of said hydrogen-rich fuel is not dissolved in said hydrogen deficient fuel. In another embodiment the present invention provides a process for reducing the sooting tendencies of a relatively hydrogen-deficient heavy liquid hydrocarbon fuel comprising physically mixing said fuel with a hydrogen-rich gas selected from the group of hydrogen, methane, ethane, propane, propylene, butane, isobutane, isobutylene, and mixtures thereof, at conditions wherein a majority of said hydrogen-rich gas remains in vapor phase, and the resulting mixture of fuel and gas are burned.

DETAILED DESCRIPTION

Hydrogen Deficient Fuels

Figure 1:
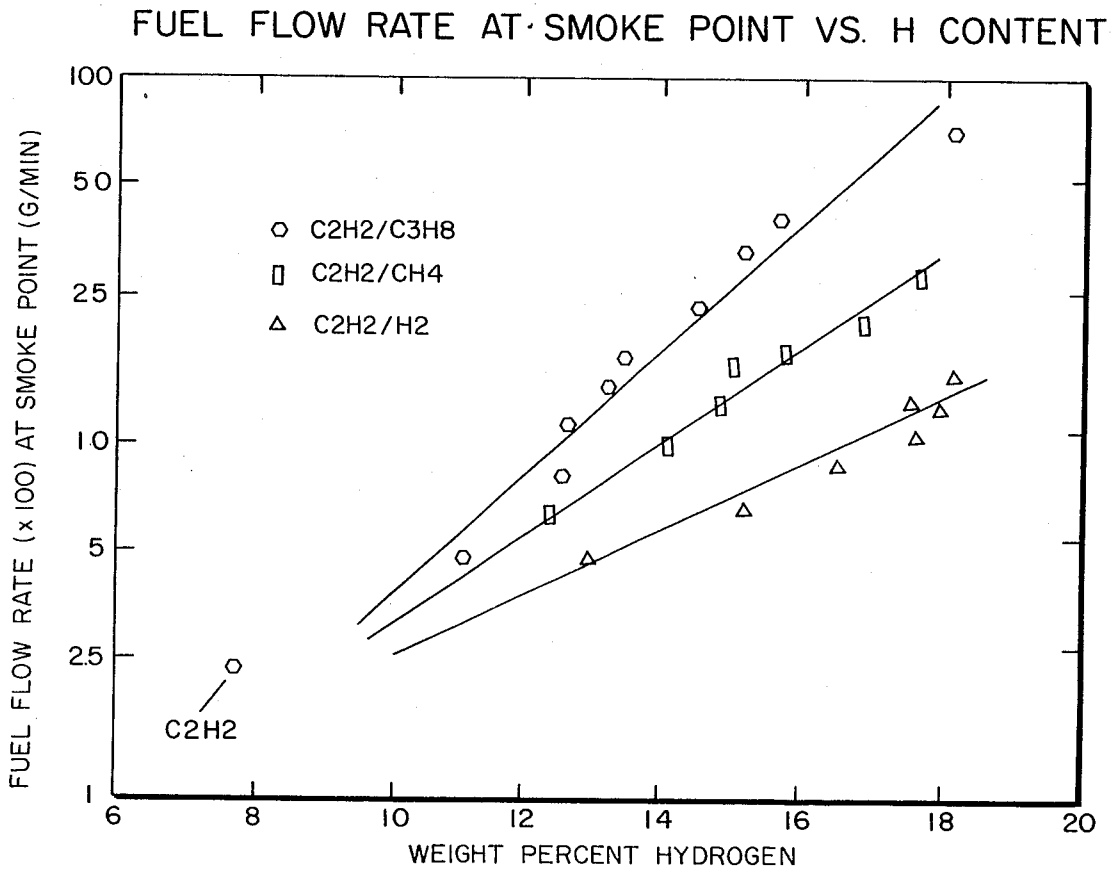
FIG. 1 is a graph of the plot of fuel flow rate (×100) at smoke point (G/Min) versus weight percent hydrogen.

The present invention may be used to upgrade the burning characteristics of any hydrogen deficient fuel.

Such fuels may be derived from all or portions of crude oil, tar sands, and may also contain combustible additives such as soot particles, coke particles, coal particles, and combinations thereof. They may be normally gaseous, acetylene is an example, but are usually liquids. Relatively light liquids may be hydrogen deficient, such as toluene and benzene. Middle distillate boiling range fuels, such as liquids derived from coal, may be hydrogen deficient. Heavy fuels, such as resids, are very aromatic and are usually hydrogen deficient.

The fuels which will benefit most from the practice of the present invention will generally have at least one, and frequently both, of the following characteristics:

1. High viscosity
2. High sooting tendency

The process of the present invention permits burning of some feeds which are highly viscous, such as asphaltic fractions, which are not suitable for use as fuel. These fuels have viscosity so high that most burners, even with pressure and steam assisted atomization, do not handle these fuels well. As burner technology improves, slightly more viscous fuels can be handled, so the concept of high viscosity is a moving target. In general, feeds are considered viscous, if they have viscosities, on a light hydrogen rich hydrocarbon free basis, above about 20 centistokes, and are very viscous if they have viscosities above 100 centistokes, at the temperatures typically experienced in an atomizer in a burner.

These low quality, viscous heavy residual fuels are deficient in hydrogen and prone to form soot. Relatively light hydrogen deficient fuels may have a sooting tendency, e.g., acetylene is a premium quality fuel, but forms soot easily upon burning.

When heavy fuels such as a resid are used herein, these may be subjected to one or more refinery processes to reduce the viscosity thereof. Visbreaking or mild thermal cracking to reduce the viscosity of the heavy feed is very commonly practiced in refineries. Such processing reduces the viscosity of the fuel, but generates some light ends leaving a slightly more hydrogen-deficient liquid product, albeit with a reduced viscosity.

When residual fuel is used as a feedstock, it will frequently be blended with one or more less viscous refinery streams, such as cutter stock, to reduce the viscosity of the fuel oil. Such blending to reduce viscosity may be used in conjunction with, or instead of, visbreaking. Blending usually will reduce viscosity, but may not have much effect on sooting tendency. This is so especially when highly aromatic cutter stocks are used. These aromatic rich materials such as FCC slurry oils, are also relatively hydrogen deficient.

All, or most likely a portion, of heavy hydrogen deficient fuels may be subjected to conventional chemical hydrotreating processes in a refinery to reduce the sulfur and nitrogen content. Such chemical hydrogenation is very expensive upgrading treatment for a heavy residual fuel which will be burned, but it will reduce somewhat the sooting tendency of the residual fuel.

Hydrogen-Rich Vapor

Any hydrogen-rich material, compared to the hydrogen-deficient fuel, which can be vaporized, may be used in the practice of the present invention.

Preferred hydrogen-rich gases are natural gas, hydrogen, methane, ethane, ethylene, propane, propylene, normal and iso-butanes, up through naphtha boiling range materials.

Although all of these materials will reduce the sooting tendencies of heavy fuels, many of the listed additives are not preferred, because they have other more valuable uses.

Pure hydrogen is a valuable commodity within a refinery, and if it is in a relatively pure state, there are usually better uses that can be made of this material than simply burning it. Where there is no other use for hydrogen rich gas, the hydrogen has no more value than its fuel value, and significant savings can be effected by admixing the hydrogen with a heavy residual fuel with an otherwise unacceptably high sooting tendency.

Methane and ethane, or mixtures of hydrogen, methane, ethane, ethylene, with minor amounts of propane and heavier materials, are especially preferred for use in the present invention. These materials are readily available in most refineries, have no value other than fuel value in normal circumstances, and are very rich in hydrogen relative to heavy fuel oils.

Propane, butane, and heavier materials can be used in the practice of the present invention, however the propane and butane represent valuable LPG products, so the use of these materials should be minimized, wherever possible.

In general, adding more combustion air to the furnace will reduce soot and smoke formation, but at a price at somewhat reduced burner efficiency and loss of heat up the furnace stack.

In general, as heat input in a burner increases, the tendency to form soot and smoke increases. The sooting tendency may be adjusted by addition of more combustion air, or by increasing the amount of hydrogen rich gas added to the fuel.

Usually the amount of light hydrogen rich fuel added to the hydrogen-deficient fuel will be relatively small, on the order of 0.5 to 50 wt% of the hydrogen deficient fuel, and preferably 1 to 20 wt%.

Another advantage of the present invention is that the hydrogen rich fuel is not dissolved in the hydrogen deficient fuel.

When heavy fuels, such as asphaltic fraction, or severely visbroken feeds, are mixed with light paraffinic hydrocarbon, sediment tends to form. Adding much propane to an asphaltic residual fuel oil would cause propane deasphalting in the fuel line, which might plug up the lines and atomizer.

In the present invention, only a minor portion, less than 50 mole % of the hydrogen rich fuel is dissolved in the hydrogen deficient fuel. Preferably, at least about 90% or more of the light, hydrocarbon rich fuel remains in the vapor phase, so that only a minimal amount dissolves in the hydrogen deficient fuel. Such an approach avoids any deasphalting in feed lines, and permits relatively low pressure operation of the hydrogen deficient fuel system, i.e., no increase in pressure is needed because no attempt is made to dissolve light materials in the hydrogen deficient feed.

Atomizers

Any conventional atomizer means which can mix the relatively hydrogen deficient fuel, usually a heavy liquid feed such as a resid, with the hydrogen rich gas can be used. An atomization aid such as steam may also be used in the practice of the present invention.

Especially preferred are those designs in which steam and heavy oil are mixed internally. Oil may be added to the oil side of the burner, while steam and hydrogen rich fuel, or alternatively only hydrogen rich fuel, are added to the steam-atomizing side of the burner. Some adjustment of the internals of the atomizer may be necessary because the hydrogen rich gas added may not behave the same way as steam.

Either internal or external mixing designs may be used—the atomizer design is not critical, so long as it mixes the hydrogen rich and hydrogen deficient fuels.

Conventional mechanical atomizers may be used. Typically, a mechanical-atomizing burner receives the oil under a pressure of about 15–20 atmospheres, absolute, preferably at a viscosity of about 150 SSU. Typically, an orifice atomizes the fuel.

Final design of the atomizer used will depend upon the precise hydrogen rich gas added and the flow characteristics of the heavy fuel oil, along with the amount and temperature of atomizing steam, if any.

Any conventional atomizer can be used in conjunction with the present invention. The invention is not a better burner, it's a way to make existing heavy fuels burn better in conventional atomizers.

Experimental

A typical resid feed was analyzed, and the results reported in Table 1.

TABLE 1

| Residual Fuel Oil Properties | |
|---|---|
| | Resid from Arabian Light Crude |
| IBP °F. | 850+ |
| IBP °C. | 454+ |
| Gravity, °API | 11.7 |
| Specific Gravity, 60/60° F. | 0.9883 |
| Pour Point, °F. | 55 |
| Pour Point, °C. | 13 |
| Viscosity @ 100° C., Cs. | 109.13 |
| Sulfur, % wt. | 3.56 |
| Carbon Residue, CCR, % wt | 11.6 |
| Nickel and vanadium, ppm | 61 |

Example 2

As resids are very hard to burn in the laboratory, a different approach was taken, burning acetylene, a hydrogen deficient fuel.

The experimental apparatus consisted basically of a laminar diffusion flame burner supplied with a mixture of acetylene and light, hydrogen rich gas. Once a flame is established, the flow rate of the acetylene is increased relative to the flow rate of light hydrogen rich gas until incipient sooting (smoke point) is observed.

The oxidant used was a 40/60 mixture of $O_2/N_2$, on a molar basis. The gases added were $H_2$, $CH_4$ and $C_3H_8$.

Figure 2:
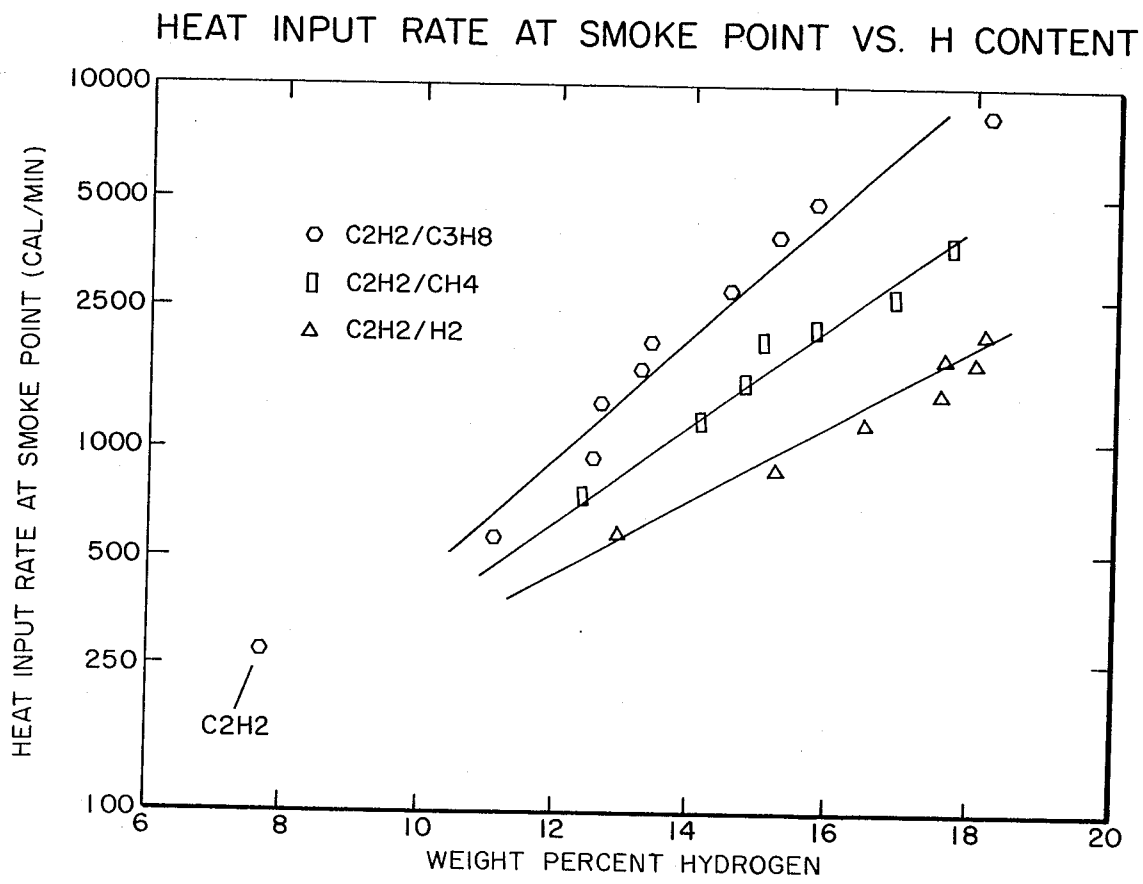
FIG. 2 is a graph of the plot of heat input rate at the smoke point (Cal/Min) versus weight percent hydrogen.

The total fuel flow rate and fuel composition are recorded. This procedure is carried out over a range of fuel flow rates and compositions. We discovered that the total fuel hydrogen content of the mixture is a good indicator of sooting tendency. The results of these smoke point observations are plotted as a function of total fuel hydrogen content and shown in FIG. 1. It is also possible to present these experimental results on the basis of heat input rate, rather than fuel flow rate. These results are shown in FIG. 2.

These experiments show that addition of a light hydrogen-rich fuel (hydrogen, methane or propane) to a hydrogen deficient fuel (acetylene) can significantly reduce the sooting tendency of the hydrogen deficient fuel, and allow greatly increased throughput.

Example 3

This example represents experiments conducted with a normally liquid, hydrogen deficient fuel. Toluene was the fuel used, instead of the acetylene used in Example 2.

Because toluene is a liquid, some modifications were necessary to the experimental apparatus. In this example, a liquid pool diffusion flame burner was used. A pool of liquid toluene was allowed to accumulate in an inverted funnel. Light, hydrogen rich gas was added just above the surface of the pool of liquid toluene, at the base of the flame. Addition of liquid toluene was precisely controlled using an ISCO pump.

The oxidant gas used was the same, namely a 40/60 percent mixture of oxygen and nitrogen, on a molar basis. The light, hydrogen-rich gases used as blending components were $H_2$, $CH_4$ and $C_3H_8$. In this experiment, as in example 1, the light hydrogen-rich gases were not dissolved in a liquid fuel, rather they were physically mixed with vaporized toluene just prior to burning of the toluene.

Figure 3:
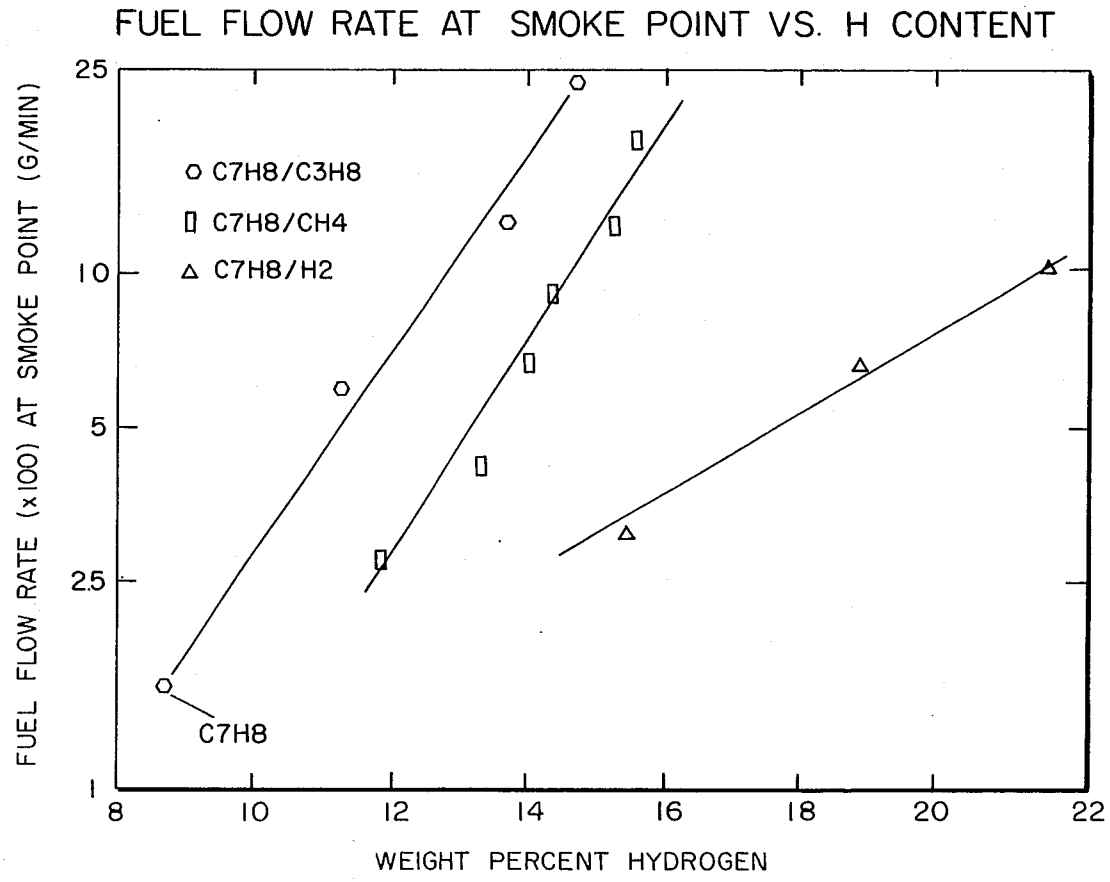
FIG. 3 is a graph of the plot of fuel flow rate (×100) at smoke point (G/Min) versus weight percent hydrogen.

Experimental results of this test are shown in FIG. 3, comparing the fuel flow rate at smoke point versus hydrogen content of the gas mixture that is being burned. This plot is analogous to FIG. 1, in that both FIG. 1 and FIG. 3 deal with fuel flow rate at the smoke point versus hydrogen content, while FIG. 2 deals with heat input rate versus hydrogen content.

In FIG. 3, the toluene/$H_2$ mixtures had smoke point values that climbed much more slowly relative to those for the $C_3H_8$ and $CH_4$ mixtures. This may mean that the very light hydrogen gas did not have time to adequately mix with toluene vapor prior to combustion, in contrast to the heavier gases $CH_4$ and $C_3H_8$ which presumably mixed better with the vaporized toluene.

Example 4—Mixing Effect

To show conclusively that intimate mixing of the hydrogen-rich light hydrocarbon gas with the hydrogen-deficient fuel is necessary to achieve a reduction in sooting tendency, additional experiments were carried out where the hydrogen-rich gas was introduced to the burner along with the combustion air, and not directly into the fuel side of the flame. In this example, propane was added to the combustion air surrounding the toluene flame at levels equivalent to 12 to 17 wt% total fuel hydrogen. No effect whatsoever was observed on soot reduction of the flame.

Best Mode

If we were practicing the present invention today, using a feedstock such as the heavy oil feed described in Example 1, we would add about 10 wt.%, based on heavy fuel oil, of a mixture of natural gas, primarily methane and ethane to the fuel oil. The gas would be added in the steam or combustion side of an atomizing burner, carrying heavy fuel oil at a temperature of 40° C. and conventional pressure. A conventional steam-atomizing burner would be used.

Our system requires no modifications whatever of fuel storage, or fuel delivery to the burner atomizers. Rather than dissolve the hydrogen-rich gases in the heavy fuel, mechanical mixing of hydrogen-rich gases with hydrogen deficient fuel in the atomizer substantially reduces the sooting tendency of the heavy fuel.

As applied to lighter fuels, such as diesel fuel, there is no need to pressurize the entire fuel system to dissolve a light hydrocarbon, e.g., propane, in the diesel fuel. Propane or ethane could be added to each cylinder at the same time, or some time before, the diesel fuel is injected. Pressured storage of light hydrogen rich hydrocarbon only will be necessary, rather than requiring high pressure storage of diesel fuel. As the light hydrogen rich gas is added just before combustion, and need never be mixed with the diesel fuel, intermittent addition can be easily practiced. Hydrogen rich fuel could be added only during times when the diesel engine tended to form soot, rather than all the time.

We claim:

1. A process for reducing the sooting tendencies of a relatively hydrogen-deficient heavy liquid hydrocarbon fuel comprising physically mixing said fuel with a hydrogen-rich gas selected from the group of hydrogen, methane, ethane, ethylene, propane, propylene, butane, isobutane, isobutylene, and mixtures thereof, at conditions wherein a majority of said hydrogen-rich gas remains in vapor phase, and the resulting mixture of fuel and gas are burned.

2. Process of claim 1 wherein said gas is selected from the group consisting of hydrogen, natural gas, methane, ethane, ethylene, and mixtures thereof.

3. Process of claim 1 wherein said hydrogen rich fuel is a light hydrocarbon gas selected from the group consisting of natural gas, methane, ethane, ethylene and mixtures thereof.

4. Process of claim 1 wherein said gas is added in an amount equal to 0.5 to 50 wt% of said heavy fuel.

5. Process of claim 1 wherein said gas is added in an amount equal to 1 to 20 wt% of said heavy fuel.

6. Process of claim 1 wherein said hydrogen deficient fuel is selected from the group of residual fuel, coal liquids and oil derived from tar sands.

7. Process of claim 1 wherein said hydrogen deficient fuel has a hydrogen content not exceeding 13 wt%.

8. Process of claim 1 wherein said hydrogen deficient fuel has a hydrogen content of 10 to 13 wt%.

9. Process of claim 1 wherein said hydrogen rich fuel is a refinery offgas and at least a molar majority of said gas, on an inert free molar basis, is methane, ethane, ethylene, and mixtures thereof.

10. Process of claim 1 wherein said hydrogen rich fuel is a refinery offgas and at least a molar majority of said gas, on an inert free molar basis, is methane, ethane, ethylene, and mixtures thereof.

11. The process of claim 1, wherein said hydrogen deficient fuel is atomized to charge said fuel into a burner.

12. A process for improving the burning characteristics of a fuel which is relatively deficient in hydrogen and has a tendency to form soot upon combustion, comprising physically admixing methane with said hydrogen deficient fuel prior to combustion, wherein a majority of said methane is not dissolved in said hydrogen deficient fuel.

13. The process of claim 12, wherein said methane is admixed with a gas selected from the group consisting of hydrogen, ethane, ethylene, propane, propylene, normal butane, isobutane, isobutylene, and mixtures thereof.

14. The process of claim 12, wherein said methane is added in an amount equal to 0.5 to 50 wt% of said hydrogen deficient fuel.

15. The process of claim 12, wherein said methane is added in an amount equal to 1 to 20 wt% of said hydrogen deficient fuel.

16. The process of claim 12, wherein said hydrogen deficient fuel is selected from the group consisting of residual fuel, coal liquids and oil derived from tar sands.

17. The process of claim 12, wherein said hydrogen deficient fuel has a hydrogen content not exceeding 13 wt%.

18. The process of claim 12, wherein said hydrogen deficient fuel has a hydrogen content of 10 to 13 wt%.

19. The process of claim 12, wherein the sooting tendencies of the fuel relatively deficient in hydrogen is reduced.

* * * * *